US009854838B1

(12) United States Patent
Laible

(10) Patent No.: US 9,854,838 B1
(45) Date of Patent: Jan. 2, 2018

(54) MODULAR MOUTHPIECE ASSEMBLY FOR AN ELECTRONIC CIGARETTE

(71) Applicant: Rodney Laible, Omaha, NE (US)

(72) Inventor: Rodney Laible, Omaha, NE (US)

( * ) Notice: Subject to any disclaimer, the term of this patent is extended or adjusted under 35 U.S.C. 154(b) by 299 days.

(21) Appl. No.: 14/849,839

(22) Filed: Sep. 10, 2015

(51) Int. Cl.
*A24F 47/00* (2006.01)

(52) U.S. Cl.
CPC ..... *A24F 47/002* (2013.01)

(58) Field of Classification Search
CPC A61M 15/06; A61M 11/042; A61M 15/0021; A61M 15/0023; A61M 15/0025; A61M 15/0026; A24F 47/008
See application file for complete search history.

(56) References Cited

U.S. PATENT DOCUMENTS 4,289,149 A * 9/1981 Kyriakou ..... A24F 13/14 131/175
7,562,656 B2 * 7/2009 Gallem ..... A61M 15/0086 128/200.14
9,101,729 B2 * 8/2015 Liu ..... A61M 15/06
9,107,456 B2 * 8/2015 Mehio ..... A24F 1/30
2015/0258288 A1 * 9/2015 Sullivan ..... A61M 15/0086 128/203.12
2016/0008557 A1 * 1/2016 Smutney ..... A61M 15/0028 128/203.15
2016/0220148 A1 * 8/2016 Reisinger ..... A63F 13/21
2016/0270446 A1 * 9/2016 Shenkal ..... A24F 47/008
2017/0000382 A1 * 1/2017 Leydon ..... A61M 15/009

* cited by examiner

*Primary Examiner* — Tulsidas C Patel
*Assistant Examiner* — Marcus Harcum
(74) *Attorney, Agent, or Firm* — Dennis L. Thomte; Thomte Patent Law Office LLC

(57) ABSTRACT

A modular mouthpiece assembly is provided for an electronic cigarette with the assembly including a high density polymer insulator, a metal collar, and an acrylic mouthpiece. The assembly also includes an optional O-ring which may be mounted on the enlarged head portion of the insulator. The modular mouthpiece assembly is designed to fit most of the presently available electronic cigarettes. Three of the four components of the assembly will have different colors to create a novel appearing mouthpiece.

9 Claims, 3 Drawing Sheets

MODULAR MOUTHPIECE ASSEMBLY FOR AN ELECTRONIC CIGARETTE

BACKGROUND OF THE INVENTION

Field of the Invention

This invention relates to a modular mouthpiece assembly for an electronic cigarette and more particularly to such a mouthpiece assembly which is configured to fit into nearly all of the electronic cigarette tanks available in the marketplace. Further, this invention relates to a modular mouthpiece for an electronic cigarette which utilizes four separate parts with three of the parts having different colors and textures to create a unique look tailored by the smoker. Even more particularly, the mouthpiece of this invention includes a high density insulator having a center bore which has a larger diameter than most of the chimneys on today's tanks.

Description of the Related Art

Electronic cigarettes have become extremely popular in the last few years. Normally, the electronic cigarettes available in the marketplace include a body portion, a battery, an atomizing device, a tobacco-liquid cup, and a mouthpiece. Usually, the mouthpiece is selectively removably secured to the body portion of the electronic cigarette. The mouthpieces of the prior art have an elongated bore extending therethrough which permits the atomized aerosol to pass into the smoker's mouth. The passage of the heated atomized aerosol through the bore of the mouthpiece may cause the mouthpiece to be heated. Further, the diameters of the prior art mouthpieces are fairly small which makes it difficult for the smoker to maintain the mouthpiece in the smoker's mouth.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A modular mouthpiece assembly is provided for an electronic cigarette with the electronic cigarette including a housing having a mouthpiece opening formed therein. The assembly comprises an elongated tubular insulator having an inner end and an outer end with the inner end of the tubular insulator having an enlarged cylindrical head portion formed thereon which has inner and outer ends. The tubular insulator has an elongated tubular body portion which extends outwardly from the outer end of the head portion. The tubular insulator has a chimney bore extending therethrough from its inner end to its outer end. The enlarged head portion of the tubular insulator is configured to be selectively removably inserted into the mouthpiece opening in the housing of the electronic cigarette.

A cylindrical metal collar is mounted on the tubular body portion of the tubular insulator adjacent the housing. A generally cylindrical mouthpiece is mounted on the tubular body portion of the insulator. The mouthpiece has an outside diameter which is greater than the outside diameter of the collar.

In the Preferred Embodiment, the tubular insulator has a first color and the mouthpiece has a second color. In the Preferred Embodiment, the mouthpiece is transparent so that the tubular body portion of the tubular insulator therein is visible through the mouthpiece. In the Preferred Embodiment, the bore in the tubular insulator has a diameter of approximately 5.7 mm.

A principal object of the invention is to provide a modular mouthpiece for an electronic cigarette.

A further object of the invention is to provide a modular mouthpiece for an electronic cigarette which utilizes four separate parts with three of the parts having different colors and textures to create a unique look tailored by the smoker.

A further object of the invention is to provide a modular mouthpiece for an electronic cigarette which includes a high density polymer insulator which cools the vapor as it is being inhaled.

A further object of the invention is to provide a high density polymer insulator having a center bore formed therein which has a larger diameter than most of the chimneys on today's tanks.

The insulator, collar, and mouthpiece have various colors to provide a unique look to the mouthpiece.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

Figure 1:
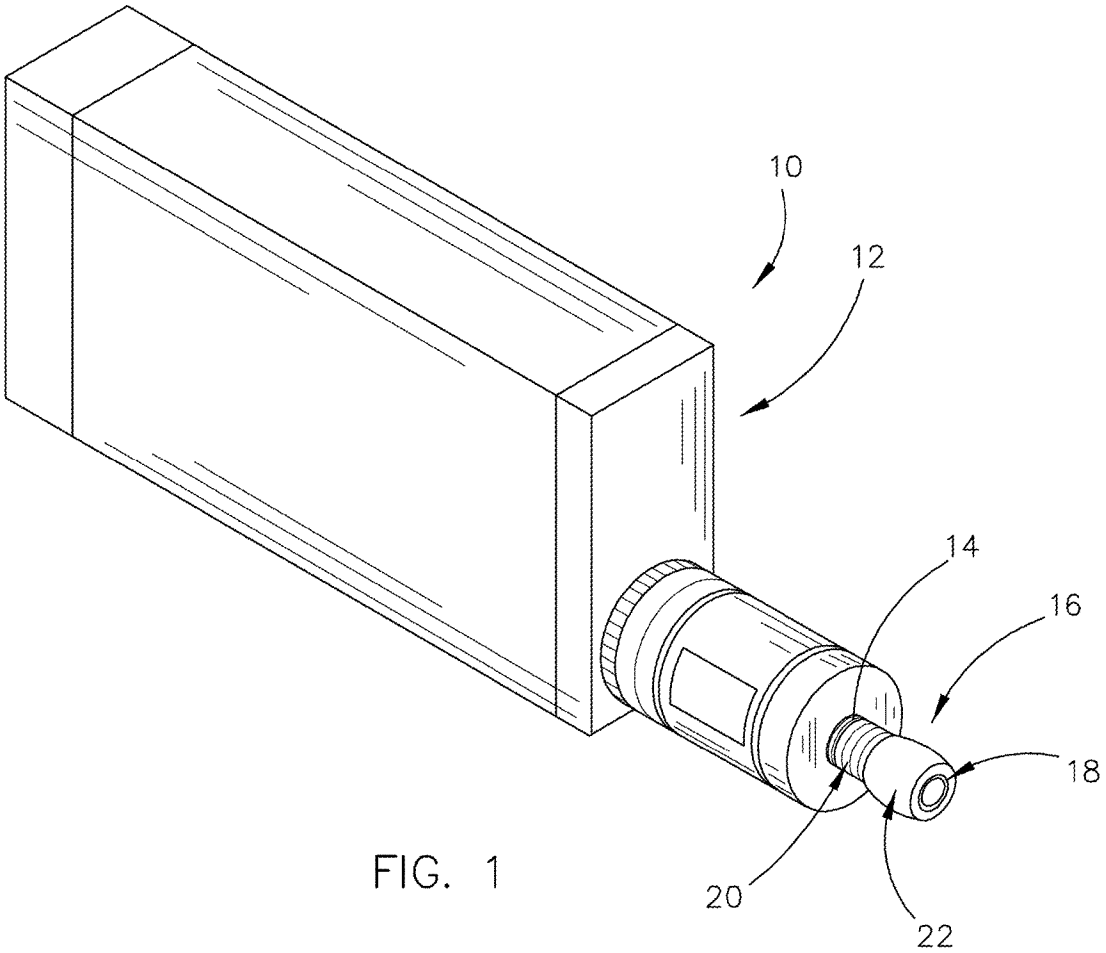
FIG. 1 is a perspective view of an electronic cigarette having the mouthpiece assembly of this invention secured thereto.

In FIG. 1, the numeral 10 refers to a conventional electronic cigarette including a housing 12 having a mouthpiece opening 14 formed therein. The numeral 16 refers to the modular mouthpiece assembly of this invention which replaces the conventional mouthpiece normally associated with the electronic cigarette 10.

Assembly 16 is modular and includes four parts or components, namely a tubular insulator 18, a collar 20, a mouthpiece 22 and an O-ring 24. Insulator 18 will be described as having an inner end 26 and an outer end 28. Insulator 18 includes an enlarged cylindrical head portion 30 at its inner end which preferably has an O-ring groove 32 formed therein configured to receive the O-ring 24 therein. Insulator 18 also preferably has an enlarged portion 34 provided thereon outwardly of head portion 30. Insulator 18 has a bore or chimney bore 36 extending therethrough which preferably has a diameter of 5.7 mm. Insulator 18 is comprised of a high density polymer. Insulator 18 may be one of six different colors, namely red, yellow, blue, pink, green or purple.

As stated, assembly 16 includes a collar 20 having an inner end 38 and an outer end 40. Collar 20 is preferably comprised of a metal material such as stainless steel or aluminum. Preferably, the exterior surface of collar 20 has spaced-apart ribs 42 formed thereon.

Figure 2:
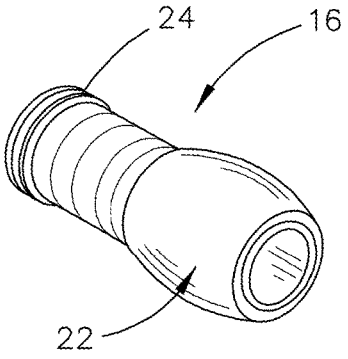
FIG. 2 is a perspective view of the mouthpiece assembly of this invention.
Figure 3:
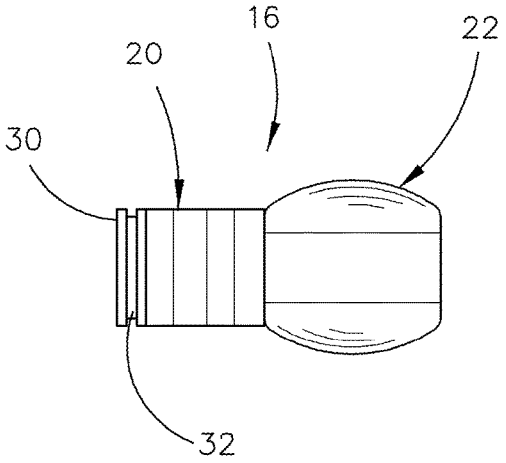
FIG. 3 is a plan view of the mouthpiece of this invention.
Figure 4:
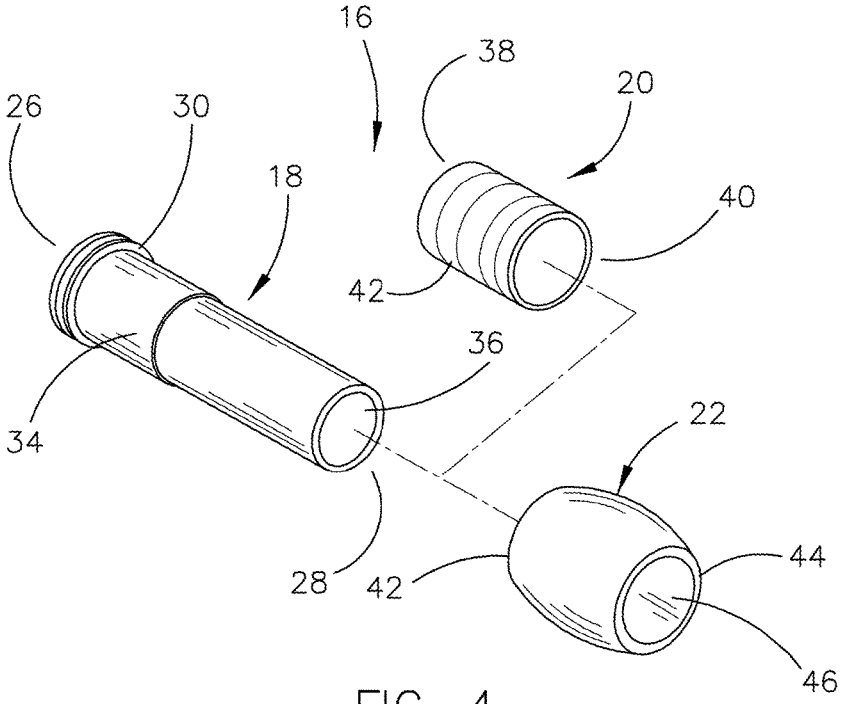
FIG. 4 is an exploded perspective view of the mouthpiece assembly of this invention.

As also stated above, assembly 16 includes a mouthpiece 22. Mouthpiece 22 is preferably comprised of an injection molded acrylic material. As seen in FIG. 2-4, the exterior of mouthpiece is somewhat oval in shape so that the center of mouthpiece 22 has a larger diameter than the diameter of collar 20. Mouthpiece 22 will be described as having an inner end 42 and an outer end 44. Bore 46 extends through mouthpiece 22. The mouthpiece 22 is preferably transparent for a purpose to be described hereinafter. Mouthpiece 22 may be of several colors such as red, yellow, blue, pink, green or purple.

Figures 5, 6, 7:
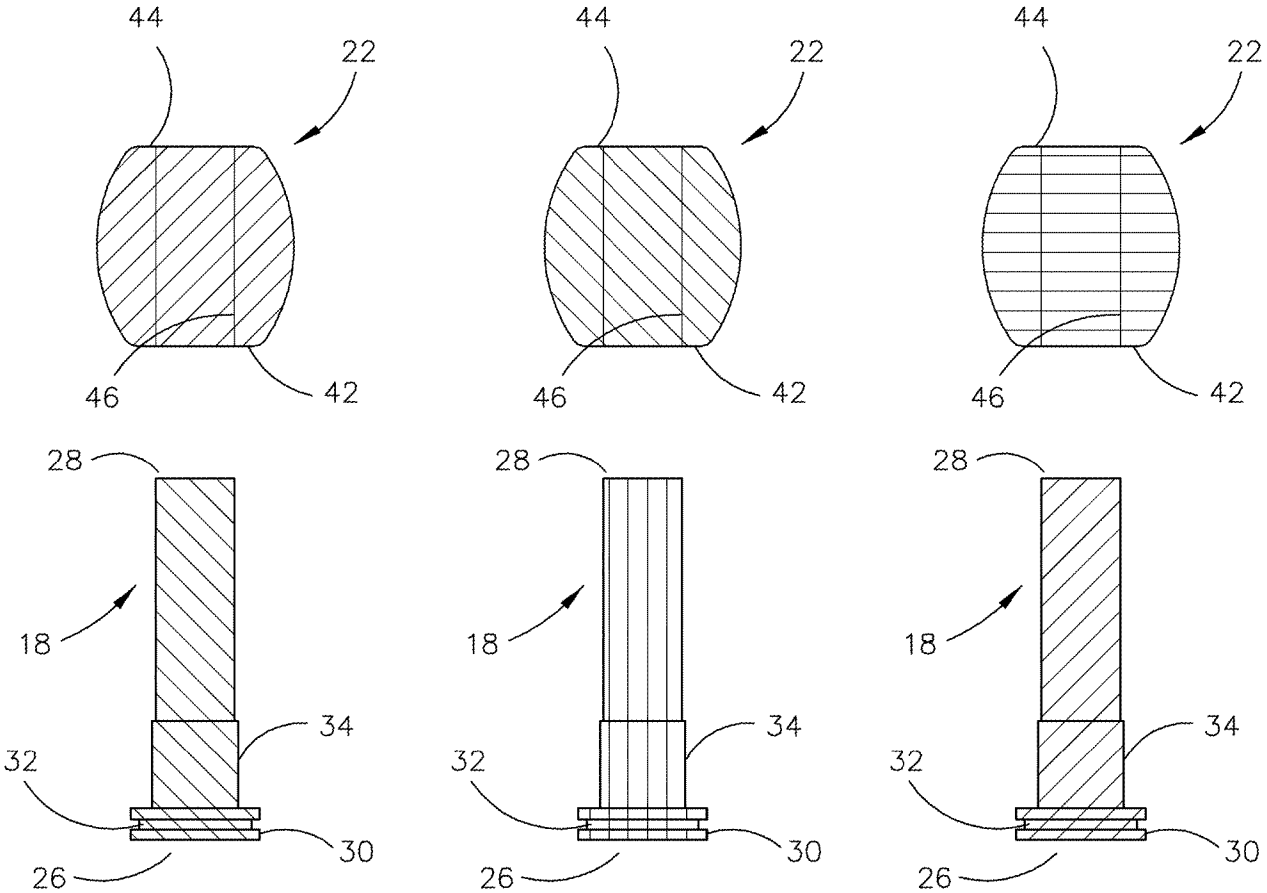
FIG. 5 is a view of a portion of the mouthpiece assembly of this invention wherein the mouthpiece and insulator thereof have different colors.
FIG. 6 is a view similar to FIG. 5 except that mouthpiece and insulator thereof have different colors wherein the colors shown in FIG. 6 are different than the colors shown in FIG. 5.
FIG. 7 is a view similar to FIGS. 5 and 6 except that the mouthpiece and insulator thereof have different colors than the colors shown in FIGS. 5 and 6.

FIGS. 5, 6 and 7 illustrate that the mouthpieces 22 have different colors from one another. FIGS. 5, 6 and 7 also illustrate that the insulators 18 have different colors from the associated mouthpieces and from one another.

As stated above, the high density polymer insulator 18, the mouthpiece 22 and the collar 20 may have various colors so that the smoker may create a unique look. The fact that the mouthpiece 22 is transparent, the insulator 18 will be visible in the mouthpiece 22.

The fact that the insulator 18 has a bore diameter of approximately 5.7 mm results in increased vapor passage therethrough. The insulator 18 absorbs heat therein which results in cooler vapor passing therethrough. The large diameter of the mouthpiece 22 makes it easier for the smoker to position the mouthpiece within the smoker's lips or mouth. In use, the collar 20, by being positioned between the housing and the mouthpiece results in a stabilizing effect for the mouthpiece.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A modular mouthpiece assembly for an electronic cigarette with the electronic cigarette including a housing having a mouthpiece opening formed therein, comprising:

an elongated tubular insulator having an inner end and an outer end;

said inner end of said tubular insulator having an enlarged cylindrical head portion formed thereon which has inner and outer ends;

said tubular insulator having an elongated tubular body portion which extends outwardly from said outer end of said head portion;

said tubular insulator having a chimney bore extending therethrough from its said inner end to its said outer end;

said enlarged head portion of said tubular insulator being configured to be selectively removably inserted into the mouthpiece opening in the housing of the electronic cigarette;

a cylindrical collar mounted on said tubular body portion of said tubular insulator adjacent the housing;

a generally cylindrical mouthpiece mounted on said tubular body portion of said insulator; and said mouthpiece having an outside diameter greater than the outside diameter of said collar.

2. The assembly of claim 1 wherein said tubular insulator has a first color and wherein said mouthpiece has a second color.

3. The assembly of claim 1 wherein said mouthpiece is transparent so that the tubular body portion of said tubular insulator therein is visible through said mouthpiece.

4. The assembly of claim 1 wherein said tubular insulator has an O-ring groove formed therein which is configured to receive an O-ring therein.

5. The assembly of claim 1 wherein said bore in said tubular insulator has a diameter of approximately 5.7 mm.

6. The assembly of claim 1 wherein said collar is comprised of a metal material.

7. The assembly of claim 6 wherein the metal material is aluminum.

8. The assembly of claim 6 wherein the metal material is stainless steel.

9. The assembly of claim 1 wherein said tubular insulator is comprised of a high density polymer.

* * * * *